US011465871B2

(12) United States Patent
Nash

(10) Patent No.: US 11,465,871 B2
(45) Date of Patent: Oct. 11, 2022

(54) TAPE DISPENSER WITH MOUNT AND ROTATION MECHANISM

(71) Applicant: 3M INNOVATIVE PROPERTIES COMPANY, St. Paul, MN (US)

(72) Inventor: James E. Nash, Bloomington, MN (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 204 days.

(21) Appl. No.: 16/962,596

(22) PCT Filed: Jan. 15, 2019

(86) PCT No.: PCT/IB2019/050305
§ 371 (c)(1),
(2) Date: Jul. 16, 2020

(87) PCT Pub. No.: WO2019/142096
PCT Pub. Date: Jul. 25, 2019

(65) Prior Publication Data

US 2020/0399087 A1 Dec. 24, 2020

Related U.S. Application Data

(60) Provisional application No. 62/620,100, filed on Jan. 22, 2018.

(51) Int. Cl.
*B65H 35/00* (2006.01)

(52) U.S. Cl.
CPC ..... *B65H 35/0026* (2013.01); *B65H 2301/41346* (2013.01); *B65H 2402/344* (2013.01); *B65H 2402/41* (2013.01); *B65H 2402/46* (2013.01)

(58) Field of Classification Search
CPC ..... B65H 35/0026; B65H 2301/41346; B65H 2402/344; B65H 2402/41; B65H 2402/46; B65H 2402/42
See application file for complete search history.

(56) References Cited

U.S. PATENT DOCUMENTS 1,656,464 A * 1/1928 Auren ..... D04B 3/06 242/594
2,339,926 A * 1/1944 Hays ..... G03D 13/145 242/596.7

(Continued)

FOREIGN PATENT DOCUMENTS

CN 2701815 5/2005
CN 105084079 A 4/2014

(Continued)

OTHER PUBLICATIONS

International Search Report for PCT International Application No. PCT/IB2019/050305, dated May 22, 2019, 4 pages.

*Primary Examiner* — William A. Rivera
(74) *Attorney, Agent, or Firm* — Vincent Pham

(57) ABSTRACT

The present disclosure relates to a tape dispenser for dispensing tape from a tape roll received therein. In one embodiment, the tape dispenser comprises a main body with a mandrel adapted to receive and releasably retain a tape roll, and wherein the mandrel allows rotation of the tape roll about a mandrel axis. It further includes a cutting arm comprising a blade attached to the main body for cutting the tape and positioned at a distance from the mandrel axis. The tape dispenser further includes an attachment unit for temporarily and releasably attaching the tape dispenser to a furniture, wherein the main body is pivotably attached to the attachment unit, and wherein a pivot axis is perpendicular to a mandrel axis.

18 Claims, 7 Drawing Sheets

(56) References Cited

U.S. PATENT DOCUMENTS

| | | | | | |
|---|---|---|---|---|---|
| 3,727,868 | A * | 4/1973 | Buchanan | B65H 35/0026 | 248/205.3 |
| 3,892,369 | A * | 7/1975 | Fujawa | B65H 35/0006 | 206/829 |
| 5,358,141 | A * | 10/1994 | Carlson | B42D 5/005 | 221/185 |
| 5,954,257 | A * | 9/1999 | Panneri | B65H 35/0026 | 225/87 |
| 6,651,857 | B1 * | 11/2003 | Tsai | B65H 35/0026 | 206/214 |
| 7,207,368 | B1 * | 4/2007 | Lyman, Jr. | B65H 35/0073 | 156/577 |
| 9,022,310 | B2 * | 5/2015 | Huang | B65H 35/0073 | 242/588 |
| 10,433,682 | B2 * | 10/2019 | McNicholas | A47K 10/22 | |
| 2005/0150923 | A1 | 7/2005 | Hsu | | |

FOREIGN PATENT DOCUMENTS

| | | |
|---|---|---|
| CN | 205864501 U | 1/2017 |
| JP | 10007309 | 1/1998 |
| JP | 2001-070660 | 3/2001 |
| JP | 2005119845 | 5/2005 |
| JP | 2014005142 | 1/2014 |
| TW | M336256 | 7/2008 |
| TW | M463250 | 10/2013 |
| TW | M506138 | 8/2015 |

* cited by examiner

TAPE DISPENSER WITH MOUNT AND ROTATION MECHANISM

CROSS REFERENCE TO RELATED APPLICATIONS

This application is a national stage filing under 35 U.S.C. 371 of PCT/IB2019/050305, filed Jan. 15, 2019, which claims the benefit of U.S. Provisional Application No. 62/620,100, filed Jan. 22, 2018, the disclosures of which are incorporated by reference in their entirety herein.

FIELD OF THE DISCLOSURE

The present disclosure generally relates to a tape dispenser for dispensing tape from a tape roll received therein.

BACKGROUND

Typically there are two categories of tape dispensers. One category concerns light-weight, often non-refillable and disposable tape dispensers which require two hands to be used. The user has to hold the housing of the dispenser while pulling off and cutting the tape. This is not convenient for every task. The other category includes desktop dispensers that are weighted to allow one-handed tape dispensing. Such dispensers usually remain on the desktop making it easily accessible. However, while the weight is necessary to facilitate one-handed dispensing, this weight can also present drawbacks. For example, these dispensers have increased manufacturing and transportation costs. In addition, some of these dispensers are bulky and can difficult to store when needed.

Therefore there is the need to provide an improved tape dispenser which allows one-handed tape dispense and a convenient use.

SUMMARY OF THE DISCLOSURE

The inventors of the present disclosure saw a need to provide an improved tape dispenser that permits at least one of lower cost, one-handed dispensing of the tape, ease of use, and/or releasable attachment to and detachment from furniture.

The present disclosure provides a tape dispenser for dispensing tape. Some embodiments of the tape dispenser comprise a main body with a mandrel coupled to the main body. In some embodiments, the mandrel is adapted to receive and releasably retain a tape roll having a central opening thereon, the mandrel allowing rotation of the tape roll about a mandrel axis. In some embodiments, the tape dispenser further includes a cutting arm comprising a blade attached to the main body for cutting the tape, the cutting arm carrying the blade at a distance from the mandrel axis. Further, in some embodiments, the tape dispenser comprises an attachment unit for temporarily and releasably attaching the tape dispenser to a furniture. In some embodiments, the main body is pivotably attached to the attachment unit, and wherein a pivot axis is perpendicular to the mandrel axis.

In some embodiments, the main body may be pivotable. In some embodiments, the main body is pivotable by at least 180°. In some embodiments, the main body is pivotable by 360°. In some embodiments, the rotational position of the main body with respect to the attachment unit may be freely selectable or a specific and defined number of positions may be provided. This may in particular be achieved by a first detent mechanism between the main body and the attachment unit.

In some embodiments, the cutting arm may be pivotable with respect to the main body. In some embodiments, the mandrel axis defines a pivot axis of the cutting arm. The cutting arm may be pivotable by 90° or more, and preferably may be pivotable by 110° or more. For holding a rotational position of the cutting arm, the tape dispenser may include a second detent mechanism between the main body and the cutting arm. In some embodiments, the second detent mechanism may be formed similar to the first detent mechanism.

In some embodiments, the attachment unit comprises a spring biased clamp for clamping the tape dispenser to the furniture. Exemplary spring biased clamps include, for example, those including a torsion spring, a compression, spring, and/or a flat spring. In some embodiments, the attachment unit comprises at least one magnet for attaching the tape dispenser to a ferromagnetic surface. In some embodiments, the attachment unit can be easily removed from the surface. Exemplary mechanisms to facilitate such removal include, for example, at least one of a vacuum or suction cup, damage-free removal adhesive (e.g., those used in the Command™ products sold by 3M Company), a c-clamp, etc. for attaching the tape dispenser to a plain surface.

BRIEF DESCRIPTION OF THE DRAWINGS

The disclosure will be further described with reference to the drawings, wherein corresponding reference characters indicate corresponding parts throughout the several views, and wherein.

DETAILED DESCRIPTION

In the following detailed description, reference may be made to the accompanying set of drawings that form a part hereof and in which are shown by way of illustration several specific embodiments. It is to be understood that other embodiments are contemplated and may be made without departing from the scope or spirit of the present disclosure. For example, the present disclosure is meant to include all types of tape roll including, for example, gift-wrapping tape, clear tape, duct tape, packaging tape, masking tape, wall-safe tape, shipping tape, Scotch™ tape, Scotch™ Magic tape, double-sided tape, super-hold tape, removable tape, book tape, etc.

Figure 1:
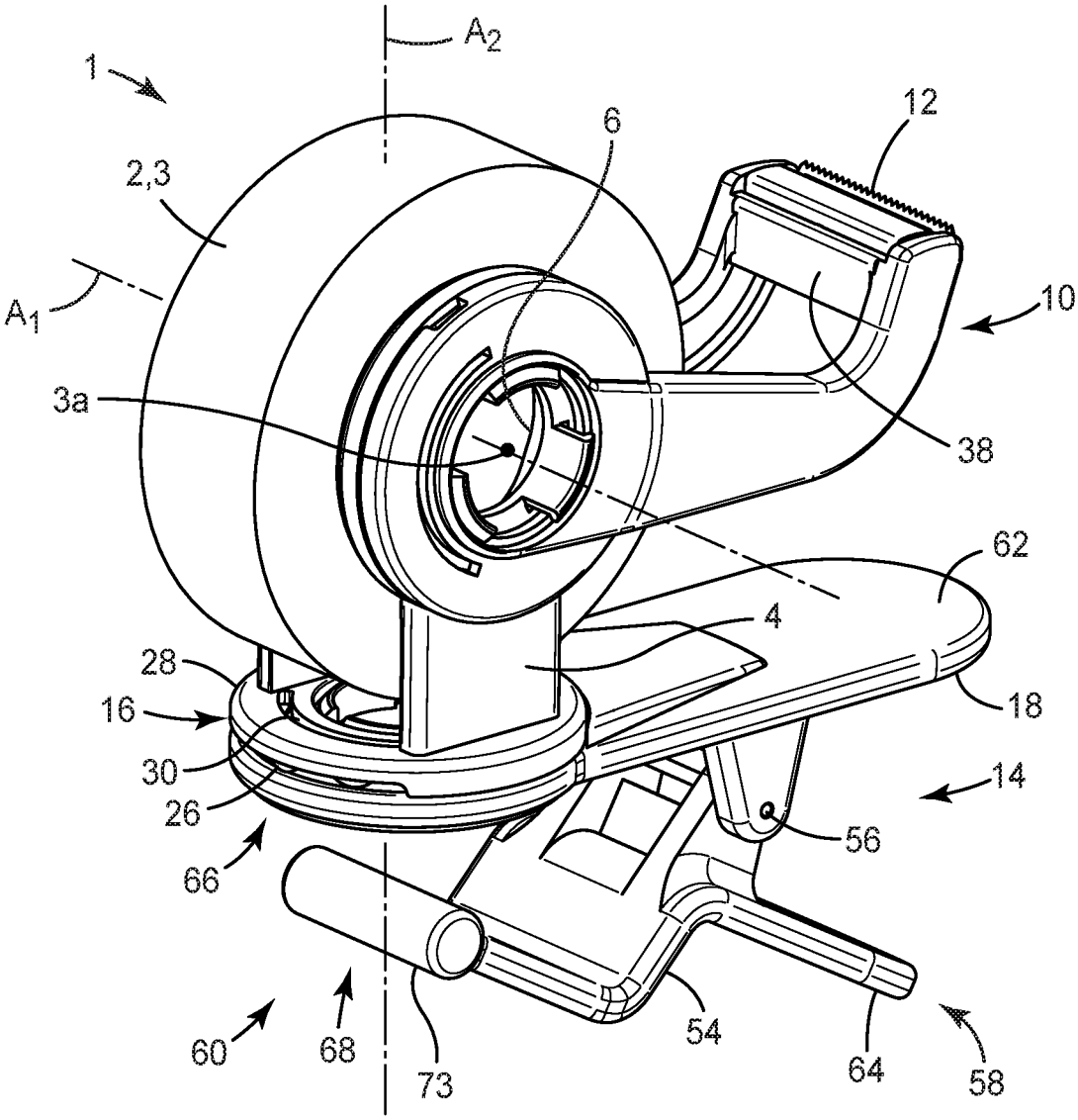
FIG. 1 illustrates a first embodiment of a tape dispenser in a perspective view.

One embodiment of a tape dispenser 1 consistent with the teachings herein is shown in FIG. 1. Tape dispenser 1 holds tape 2. Tape dispenser 1 has a main body 4 with a mandrel 6 coupled to the main body 4. Mandrel 6 is adapted to receive and releasably retain a tape roll 3 having a central opening 3*a* therein. Mandrel 6 supports the tape roll 3 and allows rotation of the tape roll 3 about a mandrel axis A1. Tape dispenser 1 also comprises a cutting arm 10 comprising a blade 12. Cutting arm 10 is attached to the main body 4 or mandrel 6 and permits the user to cut the tape 2. Cutting arm 10 carries the blade 12 at a distance from the mandrel axis A1. A further element of the tape dispenser 1 is an attachment unit 14 for temporarily and releasably attaching the tape dispenser 1 to furniture. Flexibility and usability can be enhanced in embodiments where the main body 4 is pivotably attached to the attachment unit 14, and a pivot axis A2 is perpendicular to the mandrel axis A1. Tape dispenser 1 may be attached to a piece of furniture using the attachment unit 14. As tape dispenser 1 is attached to the furniture, one-handed dispensing is then facilitated.

As used herein, the term "furniture" relates generally to any articles to which the tape dispensers described herein can be attached. In some embodiments, the articles are home or office articles. Exemplary home and office furniture includes, for example, desks, tables, room dividers, wall elements, computer stands, computers, containers, lighting devices, and other kind of home or office furniture. In other embodiments, the articles are outdoor articles such as, for example, plywood, boards, etc. In some embodiments, the articles are in manufacturing or supply chain (e.g., distribution, storage, or transit) locations such as, for example, manufacturing plants, distribution centers, and/or trucks, trains, airplanes, etc.

In one aspect of the tape dispenser 1 the main body 4 is attached to the attachment unit 14 by a pivot joint 16. The pivot joint 16 allows rotation of the main body 4 with respect to the attachment unit 14 by at least about 90°, at least about 180°, or at least about 270°. In some embodiments, the main body 4 is rotatable by 360° and more with respect to the attachment unit 14. That means, there is no stop or the like for stopping the rotation and the user may rotate the main body 4 as it is desired with respect to the attachment unit 14.

In the specific embodiment shown in FIG. 1, the attachment unit 14 includes a first attachment body 18. The first attachment body 18 provides a support for the main body 4. In this specific embodiment, the pivot joint 16 is formed between the main body 4 and the first attachment body 18. Further, in this particular embodiment, the tape dispenser 1 includes an optional first detent mechanism 20 between the main body 4 and the attachment unit 14 that provides a plurality of discrete first detent positions 22 such that a rotational position of the main body 4 with respect to the attachment unit 14 is selectable between the plurality of discrete first detent positions 22. An exemplary first detent mechanism 20 can be seen in the exploded view of FIG. 2. The first detent mechanism 20 of FIG. 2 includes a first circular rim 24 coaxially arranged with the pivot axis A2. The first circular rim 24 is provided with a plurality of preferably equally spaced recesses 25. The first detent mechanism 20 moreover comprises a first biased pin 26, which according to this embodiment (FIG. 2) is provided at the main body 4. The first biased pin 26 is adapted to be received in one of the recesses 25 thus forming a detent engagement of the first detent mechanism 20.

More specifically, in this embodiment (FIG. 2) the first biased pin 26 is integrally formed with a foot plate 28 of the main body. The footplate 28 comprises a slot 30 formed therein and adjacent to the first biased in 26 such that the first biased pin 26 may move out of a respective recess 25 when the main body 4 is rotated about the pivot axis A2. The footplate 28 moreover comprises a central hole 32 through which in an assembled state at least one engagement element is positioned. In the specific embodiment of FIG. 2, three engagement arms 33*a*, 33*b*, 33*c* extend for holding the footplate 28 against the attachment unit 14. This design may have the benefit that fewer parts are necessary for attaching the main body 4 against the attachment unit 14, even though it shall be contemplated that modifications to this connection can be made.

The main body 4 includes first and second opposing sidewalls 34, 36 extending from the footplate 28. In the embodiments shown, the first and second sidewalls 34, 36 are substantially symmetrical but this is an optional feature. Other shapes may be used. For example, in the field of tape dispensers it has become popular to use designs which resemble an animal (e.g., an elephant, bear, or cat) or sport utilities (e.g., football helmets, soccer balls, etc.). In particular when using such designs the sidewalls 34, 36 could be designed different from each other. There might also be embodiments which only involve one sidewall 34, 36 in order to ease change of tape rolls 3 for the user.

The first and second sidewalls 34, 36 may be formed integrally with the footplate 28 or formed as separate elements and then attached to the footplate 28 during assembly. Each of the sidewalls 34, 36 in this specific embodiment shown in FIG. 2 includes an inner protrusion 35, 36 together forming the mandrel 6 for receiving and supporting the tape roll 3. When changing the tape roll 3, a user bends the first and second sidewalls 34, 36 slightly away from each other, removes the old (empty) tape roll and sets in a new one. For this purpose, an opening latch or the like may be provided at least one of the first and second sidewalls 34, 36 which can be gripped by the user. The mandrel 6 is formed such that the tape roll 2 is substantially rotatable about a mandrel axis A1.

Figure 2:
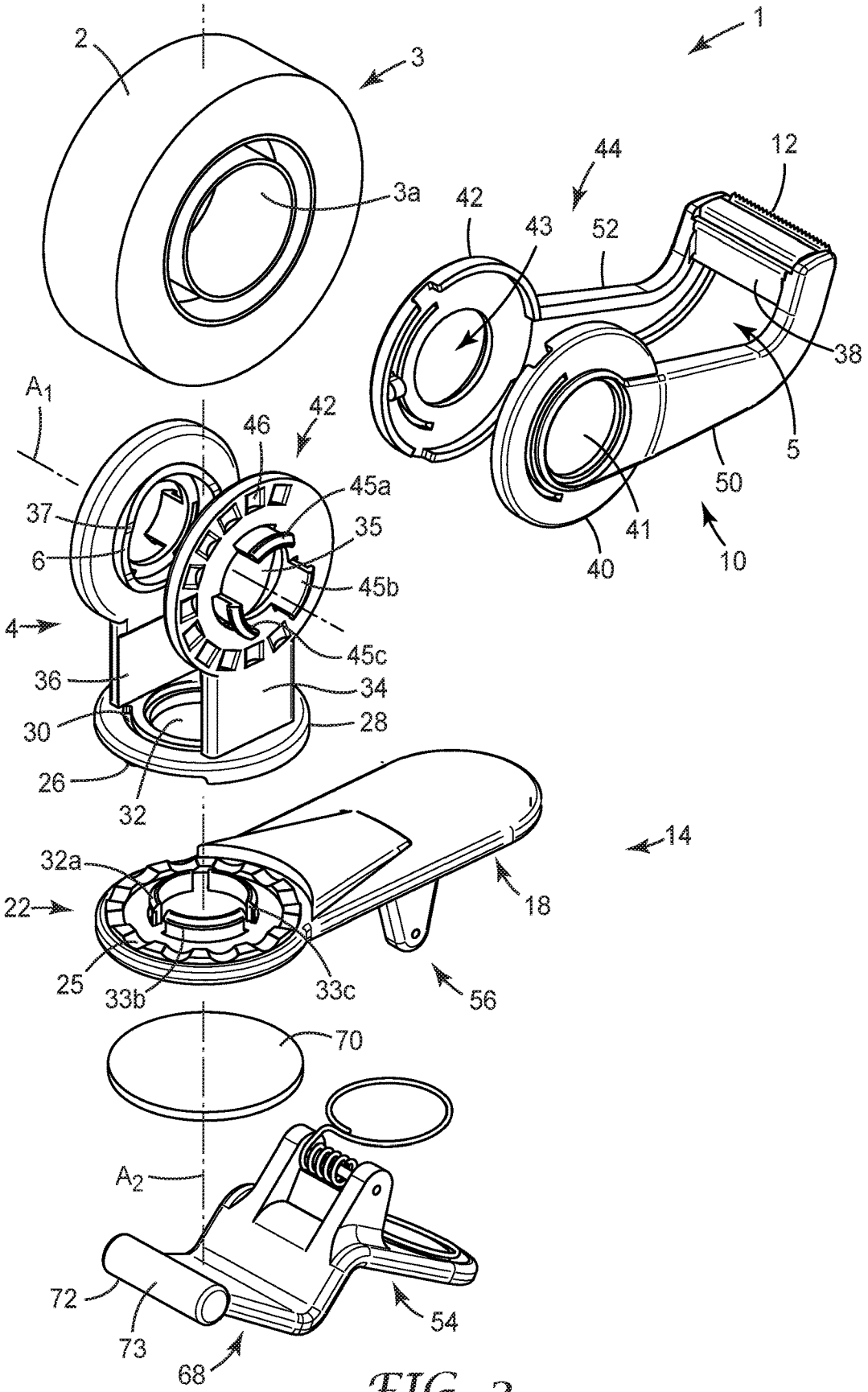
FIG. 2 illustrates an exploded view of the tape dispenser of FIG. 1.
Figure 4:
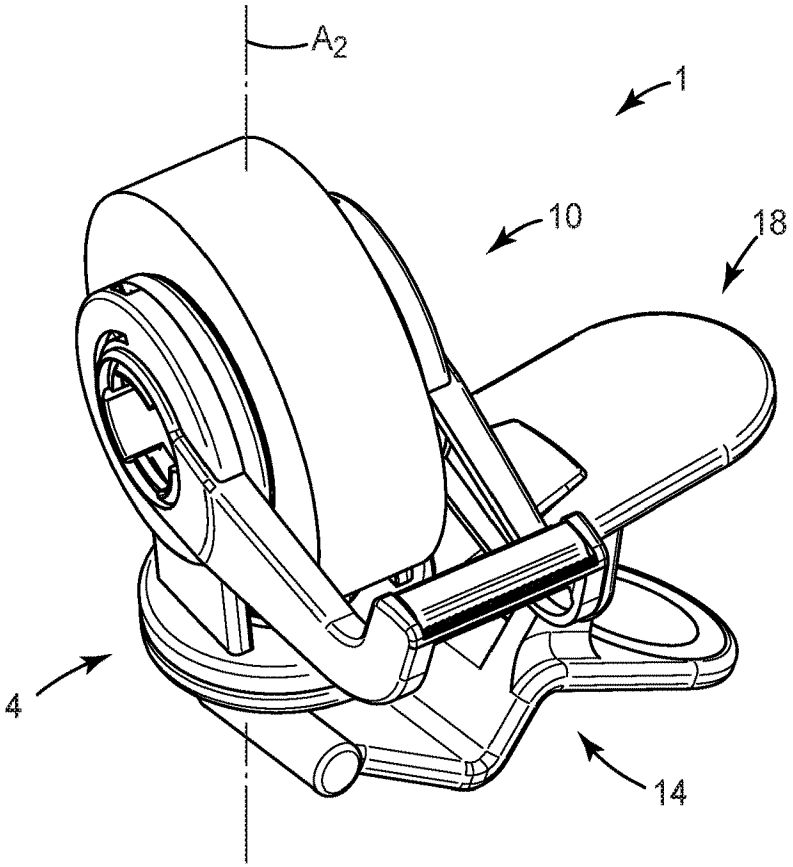
FIG. 4 illustrates the tape dispenser of FIG. 3 with the main body rotated in a third rotational position.
Figure 3:
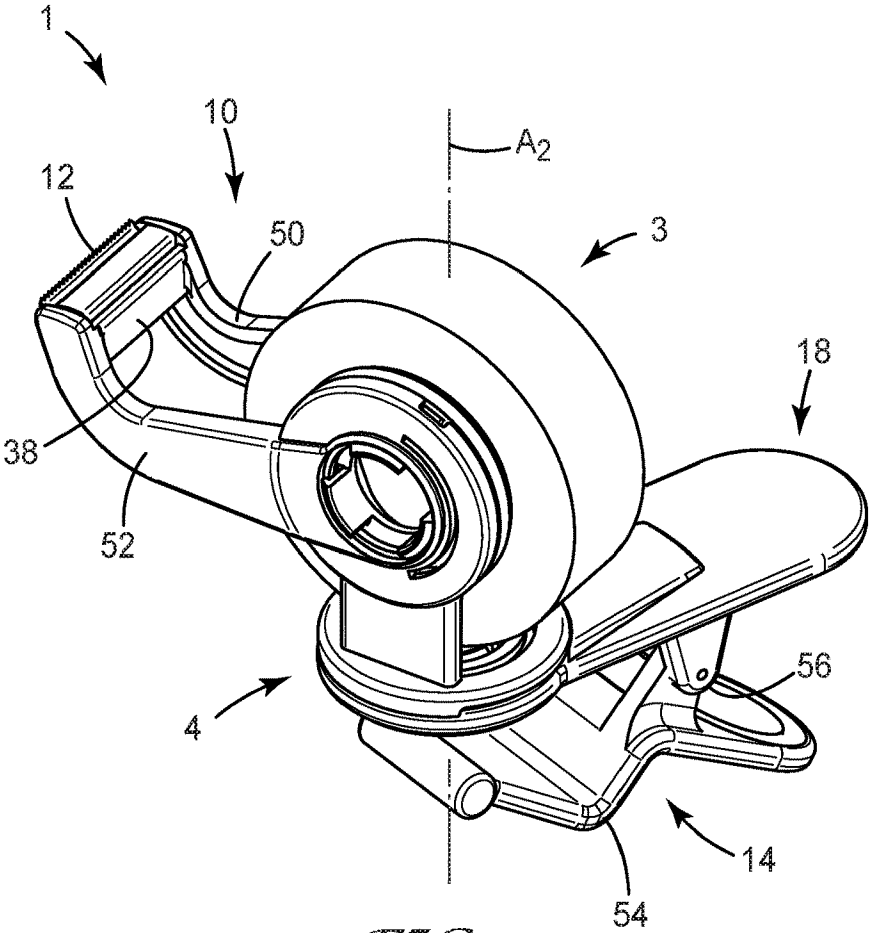
FIG. 3 illustrates the tape dispenser of FIG. 1 with the main body rotated in a second rotational position.
Figure 6:
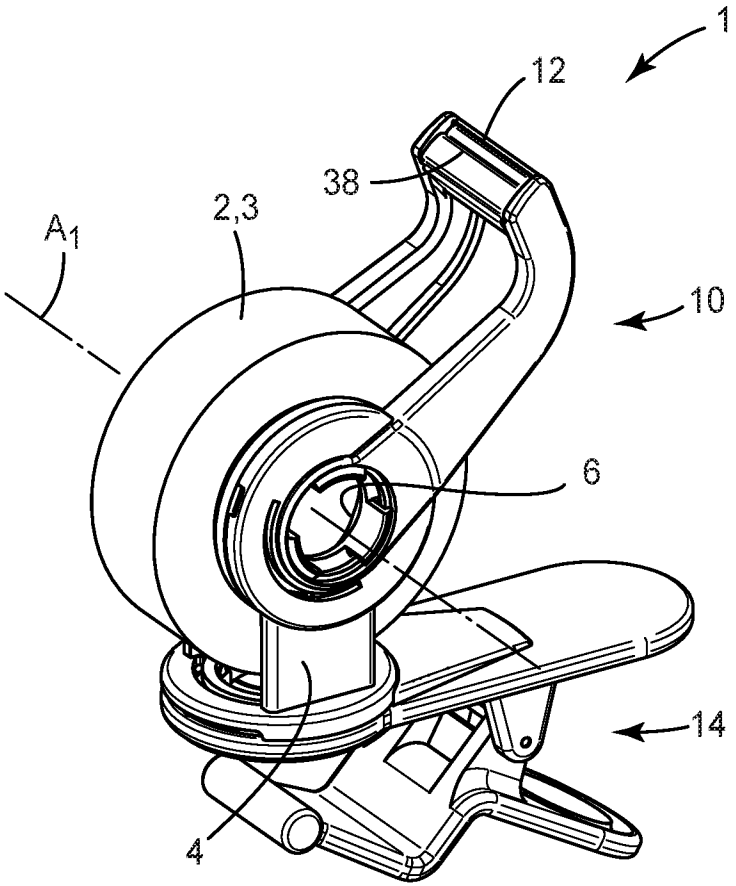
FIG. 6 illustrates the tape dispenser of FIG. 5 with the cutting arm rotated in a third rotational position.
Figure 5:
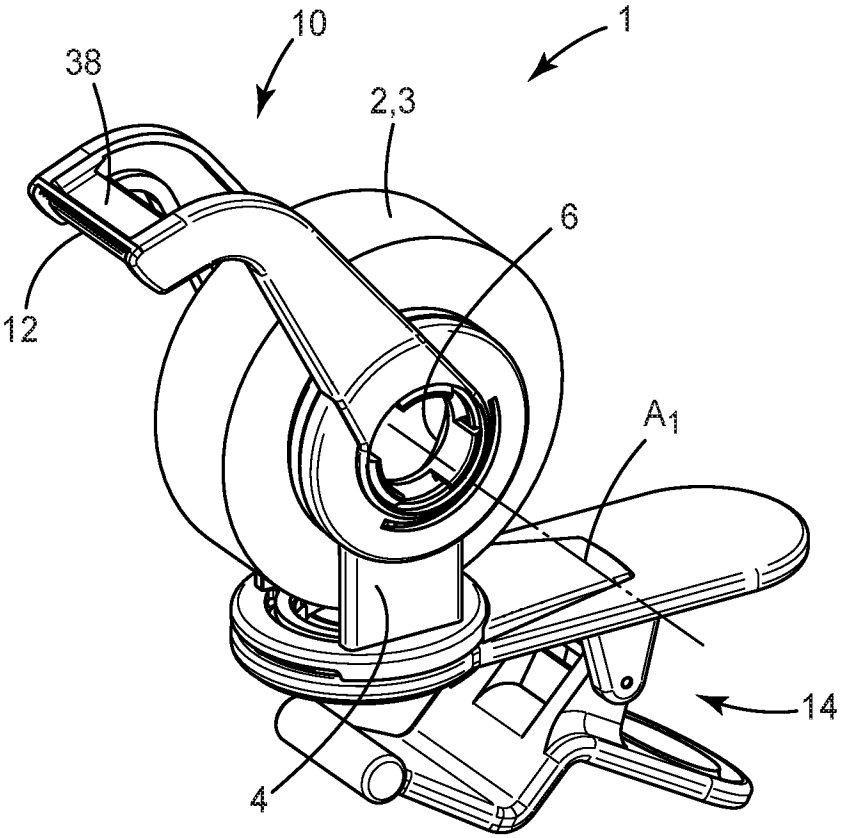
FIG. 5 illustrates the tape dispenser of FIG. 1 with the cutting arm rotated in a second rotational position.

The tape dispenser 1 of FIGS. 1 and 2 moreover includes the cutting arm 10 which carries the blade 12. The blade 12 is used to cut tape 2 which can be drawn from the tape roll 3. The blade 12 is provided at a distance to the mandrel axis A1. The distance can be chosen dependent on the specific requirements and design. The blade 12 is supported by a blade support 38 formed integrally with the cutting arm 10. In some embodiments, the blade 12 may be formed integrally with the blade support 38. This is in particular beneficial, when a blade 12 made of plastic is used. Many embodiments, however, may include a metal blade 12. Blades 12 may be adhered to the blade support 38 or at least partially anchored therein.

In the specific embodiment shown in FIGS. 1 and 2, the cutting arm 10 includes first and second shoulder plates 40, 42, The first and second shoulder plates 40, 42 are adapted for engagement with the first and second sidewalls 34, 36, respectively, of the main body 4. The cutting arm 10 is attached to the main body 4 using a second detent mechanism 44. The second detent mechanism 44 is formed similar to the first detent mechanism 20 described above. Therefore, in the shown embodiments the first and second shoulder plates 40, 42 include a central through hole 41, 43 which mates with at least one corresponding engagement element on each of the first and second sidewalls 34, 36. The engagement elements include in the shown embodiment (FIG. 2) three engagement arms 45*a*, 45*b*, 45*c* (only identified with reference signs on the first sidewall 34) extending for respective first and second sidewalls 34, 36 outwardly. In the assembled state, the engagement arms 45*a*, 45*b*, 45*c* of each sidewall 34, 36 extend through the respective through opening 41, 43 of the first and second shoulder plates 40, 42 for holding the first and second shoulder plates 40, 42 against the sidewalls 34, 36.

The first and second sidewalls 34, 36 are provided with a plurality of recesses 46 arranged in a circle coaxially with the mandrel axis A1 (in FIG. 2 only the recesses 46 of the first shoulder plate 40 can be seen). The recesses 46 define a plurality of second detent positions 47 for the cutting arm 10. The first and second shoulder plates 40, 42 comprise each a respective second and third biased pin 48 (only pin 48 of the second shoulder plate 42 can be seen), which engage the respective recesses 46. In this manner a plurality of distinct detent positions for the cutting arm 10 with respect to the main body 4 is provided.

Specifically, the pivot axis of the cutting arm 10 can be identical to the mandrel axis A1 in this embodiment, even though this is not necessary; they could be provided with a distance to each other as long as they are parallel to each other. A detent moment which may be required to rotate the cutting arm 10 to the next detent position preferably is higher than a moment acting on the second detent mechanism 44 due to a reaction force during a tape cutting step. In some embodiments, the detent moment exceeds the reaction moment by at least about 1.5, or 2.0, or 2.5, or 3.0 times. In some embodiments, the detent moment is high enough such that the cutting arm 10 may keep its position when one-handed tape dispensing and cutting is carried out by a user in a normal and average manner using regular tape.

In the first embodiment (FIGS. 1-6) the cutting arm 10 includes first and second legs 50, 52 extending from the first and second shoulder plates 40, 42 respectively and substantially perpendicular to the mandrel axis A1 and parallel to each other toward the blade support 38. The first and second legs 50, 52 connect the blade support 38 to the first and second shoulder plates 40, 42. In this embodiment, the first and second legs 50, 52 are curved to provide a free space S between the cutting arm 10 and a tape portion extending from a tape roll 3 to the blade 12. In the specific embodiments shown in FIGS. 1-6, the first and second legs 50, 52 are curved downwardly with respect to the blade 12 to resemble a concave shape. Hence, the first and second legs 50, 52 provide the space S in the concavity formed between the imaginary line running from the blade 12 toward the tape roll 3. When a tape portion extends from the tape roll 3 to the blade 12 the user may place its finger between the lower side (usually the adhesive surface of the tape) and the first and second legs 50, 52 to grip the tape 2.

In this specific embodiment, the attachment unit 14 is generally formed as a clip. In this instance the attachment unit 14 comprises a second attachment body 54 hinged to the first attachment body 18 via a hinge 56. The attachment unit 14 comprises a gripping portion 58 and a clamping portion 60. The gripping portion 58 comprises first and second gripping sections 62, 64 which can be contacted by a user and pushed together against a force of a spring (not shown) such that the clamping portion 60 is being opened. The clamping portion 60 on the other hand comprises first and second clamping portions 66, 68. The first clamping portion 66 is formed at the first attachment body 18 and the second clamping portion 68 is formed at the second attachment body 54. The second clamping portion 68 in particular is substantially L-shaped to provide a large opening between the first and second clamping portions 66, 68 when opened. This may allow attachment of the tape dispenser 1 to, for example, desks with a relatively thick plate, (e.g., 1 inch (2.54 cm) and more). In particular embodiments, the receiving opening may have a receiving width in the range of 0.5 cm (0.19 inch) to 3.5 cm (1.38 inch).

The first clamping portion 66 in this first embodiment (FIG. 1 through 6) includes an optional pad 70 formed of or comprising a non-slip material. The pad 70 may be adhered to a surface of the first attachment body 18. Examples for non-slip materials include thermo plastic elastomer (TPE)-containing materials, neoprene-containing materials, silicone-containing materials, and rubber-containing materials (including natural and synthetic rubbers). The second clamping portion 68 comprises a contact element 72, which in this embodiment is formed as a rounded body, in particular a substantial cylindrically formed contact element 73. By introducing a rounded body as the contact element 72 a proper contact irrespective of the width of the opening between the first and second clamping portions 66, 68 in an attached or clamped state may be achieved. It shall be noted, that even if the second clamping portion 68 is not shown to include a non-slip material, such a material may be involved in addition to the pad 70 or as a substitute. For example, the contact element 72 may be formed out of non-slip material or a layer of non-slip material may be added to an outer surface of the contact element 72.

The specific embodiments shown in FIGS. 7 through 10 of the present disclosure vary from the first embodiment (shown in FIGS. 1 through 6) mainly in the design of the cutting arm 10 and the attachment unit 14. As such, the following description will focus on the differences with the embodiment shown in FIGS. 1 through 6.

In the embodiment shown in FIG. 7, the cutting arm 10 again comprises first and second legs 50, 52. In this embodiment, first and second legs 50, 52 have a joined portion 76 where they converge toward each other and are joined together. The joined portion 76 is connected to the blade support 38 supporting the blade 12. In this arrangement, a free space S is formed or provided adjacent to the joined portion 76 under a tape portion extending from the tape roll 3 to the blade 12. This permits and/or facilitates easy gripping of the tape 2 from either side of the cutting arm 10.

The attachment unit 14 includes a contact element 72 at the second clamping portion 68. In this embodiment, the contact element 72 is formed from non-slip material and is attached, (e.g., adhered) to a surface of the second clamping portion 68. In particular, the contact element 72 is formed as a spherical contact body 78 which might be elastic. In one example the spherical contact body 78 is formed from any of the non-slip materials described above.

Figure 8:
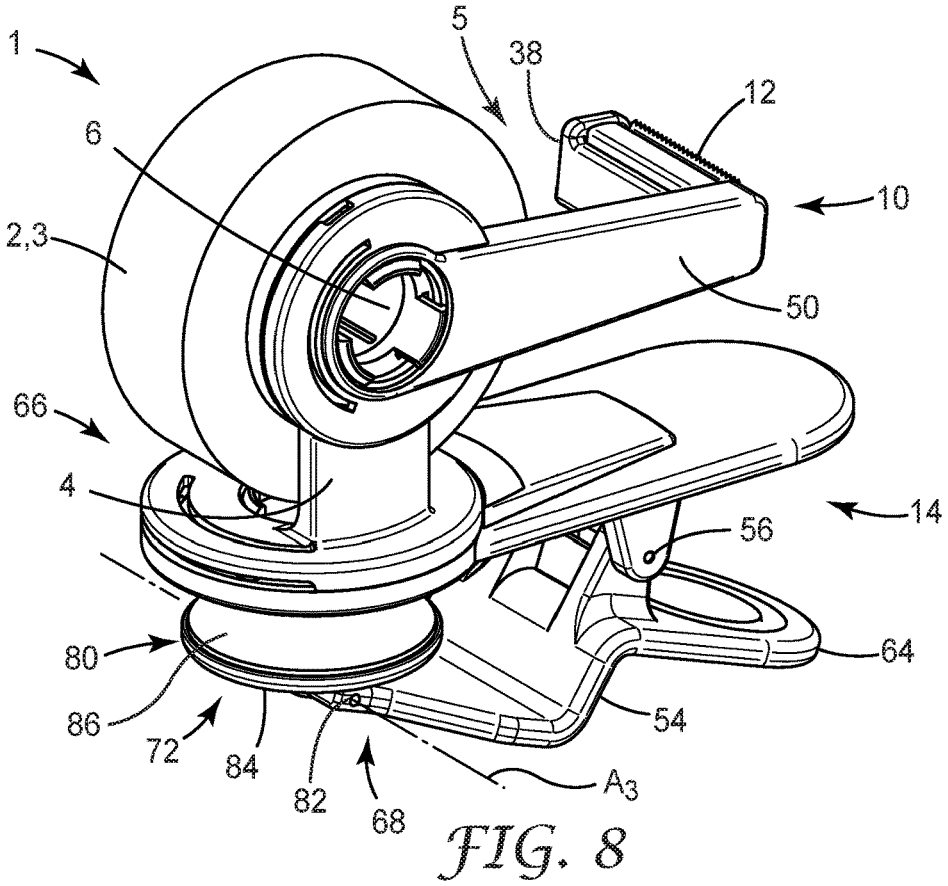
FIG. 8 illustrates a third embodiment of a tape dispenser in a perspective view.

Another exemplary embodiment is shown in FIG. 8. In this embodiment, the cutting arm 10 only includes the first leg 50 and no second leg. In contrast to the embodiment shown in FIGS. 1-6, the first leg 50 in this embodiment is straight and not curved, even though a curved configuration may be used. As there is no second leg, a free space S is formed to ease gripping of a tape portion extending from the tape roll 3 to the blade 12. A user may put his/her finger in the region where the second leg 52 is provided in the first embodiment, and grip the tape 2 to pull it out and cut it afterwards.

Additionally, the second clamping portion 68 is formed differently compared to the embodiments shown in FIGS. 1-7. The second clamping portion 68 includes a contact element 72, which in this embodiment (FIG. 8) is in the form of a movable plate 80. The movable plate 80 is connected to the second attachment body 54 via hinge 82 at the opposite end to the second gripping section 64. Hence, the plate 80 is pivotable, preferably about a third axis A3 which is parallel to an axis of the hinge 56. The plate 80 in this embodiment may comprise a plate body 84 which might be formed from a plastic material and preferably is substantially rigid. On a surface of the plate body 84, an optional a pad 86 made from or comprising non-slip material may be provided. The pad 86 may be substantially similar to the pad 70 which is attached to the first attachment body 18. When clamped against a furniture, the second clamping portion 68 will be pushed by the force of the spring against the plate 80 and thus, the plate 80 will be forced into a position in which the pad 86 is in contact with the furniture substantially over its full contacted surface. Hence, this embodiment may provide a large contact surface of the first and second clamping portions 66, 68 irrespective of a thickness of the portion of the furniture the tape dispenser 1 is attached to.

Figure 9:
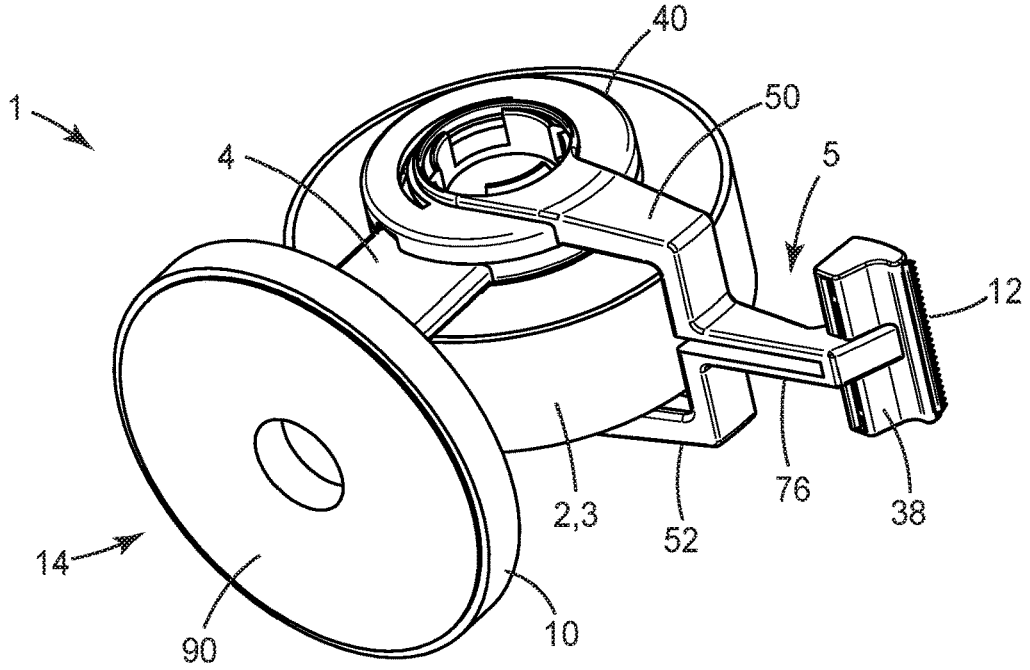
FIG. 9 illustrates a fourth embodiment of a tape dispenser in a perspective view in which the attachment unit comprises a magnet.
Figure 10:
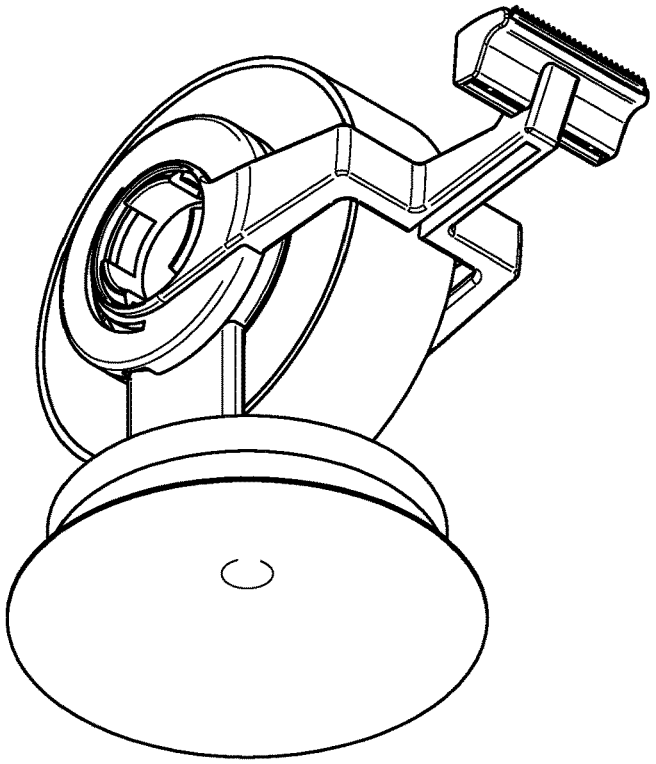
FIG. 10 illustrates a first embodiment of a tape dispenser in a perspective view in which the attachment unit comprises vacuum cup.

Another embodiment is shown in FIG. 9. In this embodiment, the tape dispenser 1 is shown with a similar cutting arm 10 as has been implemented in the embodiment shown in FIG. 7. Also the cutting arm 10 according to this embodiment includes the joined portion 76. The attachment unit 14 according to this embodiment (FIG. 9) differs from the first three embodiments insofar as it only includes a first attachment body 18 but no second attachment body 54. The attachment unit 14 in this embodiment is not formed as a clip. Rather it comprises a magnet 90 attached to and partially received in the first attachment body 18. The magnet 90 may also be completely encased by the first attachment body 18. The magnet 90 may be, for example, a rare-earth-magnet. By use of the magnet 90 the tape dispenser 1 may be attached via the attachment unit 14 to magnetic furniture comprising at least one magnetic part (e.g., an iron metal part). The tape dispenser of this embodiment may have a higher weight than the tape dispensers shown and described above due to the presence of the magnet 90.

Figure 7:
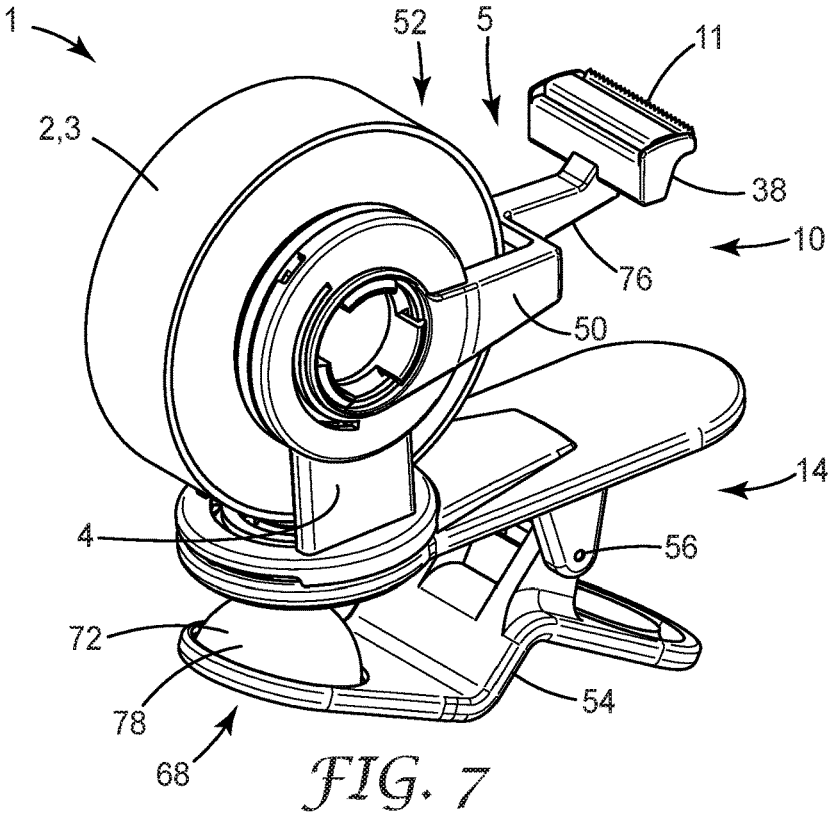
FIG. 7 illustrates a second embodiment of a tape dispenser in a perspective view.

It shall be contemplated, that the different designs of cutting arms 10 and attachment units 14 may be freely interchanged between the embodiments. For example the first embodiment (FIGS. 1 through 6) may have a cutting arm 10 shown in the second embodiment (FIG. 7), or the third embodiment (FIG. 8) may have an attachment unit 14 as shown in the second embodiment (FIG. 7). In this manner different designs of the tape dispenser 1 according to the present disclosure can be found without departing from the disclosure.

Some tape dispensers described herein have a weight without tape roll 3 of less than 150 g (5.3 oz), or less than about 140 g (5 oz), or less than about 120 g (42.2 oz).

The tape dispensers described herein may be useful for those who do not need a tape dispenser during their regular day to day work, but rather for specific tasks, such as for example, during the holiday season when multiple packages have to be wrapped in a short time. Such users usually do not require a bulky weighted dispenser, but they want to be able to do one-handed tape dispensing, which is particularly beneficial when wrapping presents or similar tasks, where one hand often is used to temporarily hold to pieces together, and the other hand is used to pick up a piece of tape. The tape dispensers described herein can also be useful for those who need a tape dispenser during their regular day to day work but who are mobile, in a small space, or want to be able to at least temporarily position their tape dispenser vertically.

Figure 11C:
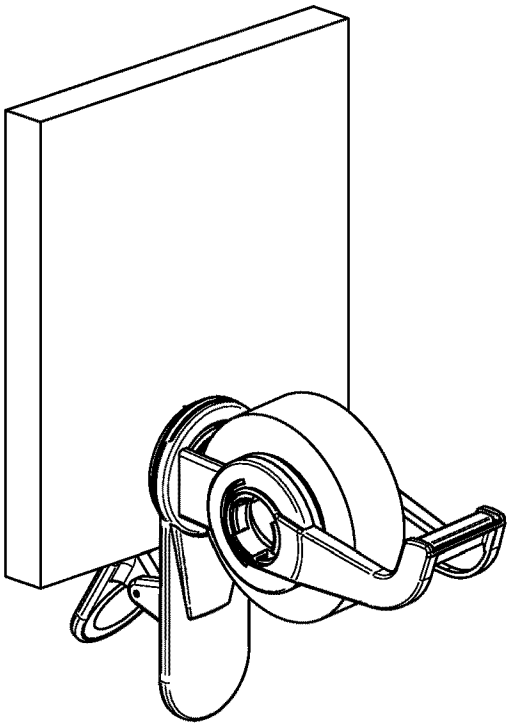
FIGS. 11A-C illustrate three different embodiments of a tape dispenser as generally described herein attached to a vertical wall or surface.
Figure 11B:
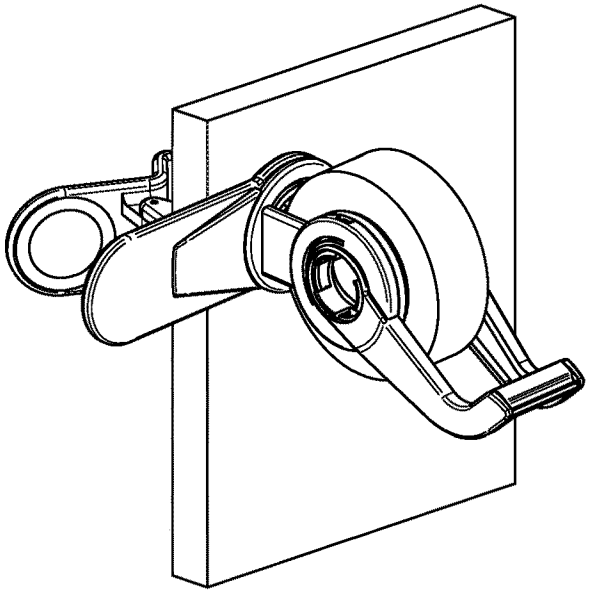
Figure 11A:
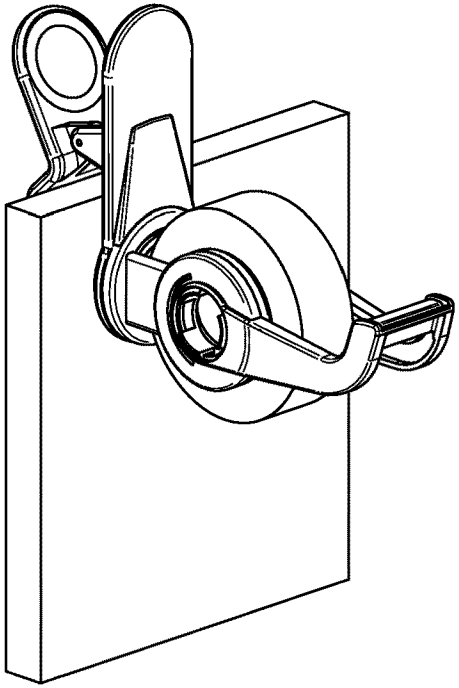

FIGS. 11A-C illustrate three different embodiments of a tape dispenser as generally described herein attached to a vertical wall or surface.

Prior art tape dispensers can be placed in 2 general categories. Ones that are light weight, often non-refillable, require 2 hands to use, and are disposable; and those that are positioned on the desktop, weighted to allow one-handed tape dispensing and are refillable. The disposable dispensers are less expensive while the desktop versions cost more initially but then can be refilled at a lower cost as you use more tape. Desktop dispensers also have the benefit of remaining on the desktop making it easily accessible. Disposable dispensers are often left in a drawer, out of sight/out of mind.

In contrast, the tape dispensers of the present disclosure have various benefits and advantages over these prior art tape dispensers. In some embodiments, a clamping mechanism is used to secure the tape dispenser and to permit one-handed dispensing of the tape by the user. In some embodiments, in addition to using a clamping mechanism, the tape roll and blade can be rotated independently, increasing the options on how the dispenser can be positioned and used. In some embodiments, the tape dispensers described herein use a clamping mechanism to secure the dispenser to provide one-handed dispensing of the tape. Where present, the clamp feature allows the user to remove ballast weight often used in desktop dispensers to keep them from moving when tape is dispensed. In some embodiments, in addition to using a clamping mechanism, the tape roll and blade can be rotated independently. The ability to rotate the blade and tape roll independently makes it so the dispenser can be clipped to the edge of the work surface, on vertical dividing walls or privacy panels, a nearby shelf, or the edge of a computer monitor. These are all options that could save desk space and still be accessible and permit one handed dispensation of tape.

By removing the weight from the desktop dispenser and using a clamp to secure it, the tape dispensers of the present disclosure can be made smaller and less expensive than a standard desktop dispenser. The tape dispensers described herein have the same advantages over a disposable dispenser as a conventional desktop version but with reduced cost and a more compact size.

Also, the ability to rotate the blade and tape roll independently distinguishes the tape dispensers of the present disclosure from both the conventional dispenser types. These features makes it so the dispenser could be clipped to the edge of the work surface, on vertical dividing walls or privacy panels, a nearby shelf, or possibly a computer monitor. All options that could save desk space and still be accessible and one handed.

The small size and one-handed feature also makes the dispensers of the present disclosure good for a variety of uses. For example, these benefits are useful in home use where desktop dispensers are not often seen. A tape dispenser of the present disclosure can easily be kept in a drawer and then when needed, be attached to, for example, the kitchen table etc. One handed dispensing can be very useful when wrapping gifts, the main home use of tape, and the clip-on feature provides this benefit in a compact and flexible solution.

For purposes of clarity, it is contemplated that any specific aspect of any embodiment described herein can be combined with any embodiment and/or any aspects of any embodiment described herein such that there are various combinations or permutations of the embodiments specifically articulated.

The recitation of all numerical ranges by endpoint is meant to include all numbers subsumed within the range (i.e., the range 1 to 10 includes, for example, 1, 1.5, 3.33, and 10).

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Those having skill in the art will appreciate that many changes may be made to the details of the above-described embodiments and implementations without departing from the underlying principles thereof. Further, various modifications and alterations of the present disclosure will become apparent to those skilled in the art without departing from the spirit and scope of the disclosure. The scope of the present application should, therefore, be determined only by the following claims and equivalents thereof. Various embodiments and implementations are described herein. These embodiments should not be construed as limiting the scope of the present application in any manner, and changes and modifications may be made without departing from the spirit and scope of the present disclosure. Further, only some end uses have been discussed herein, but end uses not specifically described herein are included within the scope of the present application. As such, the scope of the present application should be determined by the claims.

What is claimed is:

1. A tape dispenser, comprising:

a main body coupled to a mandrel, wherein the mandrel is adapted to receive and releasably retain a tape roll having a central opening thereon, and wherein the mandrel allows rotation of the tape roll about a mandrel axis, a cutting arm comprising a blade capable of cutting the tape; wherein the cutting arm is attached to the main body and/or the mandrel and wherein the blade is positioned at a distance from the mandrel axis; and an attachment unit for temporarily and releasably attaching the tape dispenser to a furniture;

wherein the main body is pivotably attached to the attachment unit, and wherein a pivot axis that passes through the attachment unit and is perpendicular to and intersects the mandrel axis and wherein either (i) the cutting arm is pivotable with respect to the main body, or (ii) the tape dispenser further comprises a first detent mechanism between the main body and the attachment unit providing a plurality of discrete first detent positions such that a rotational position of the main body with respect to the attachment unit is selectable between the plurality of discrete first detent positions, or both (i) and (ii).

2. The tape dispenser according to claim 1, wherein said main body is pivotable by at least 180°.

3. The tape dispenser according to claim 1, wherein a rotational position of the main body with respect to the attachment unit is freely selectable.

4. The tape dispenser according to claim 3, wherein the selected rotational position of the main body relative to the attachment unit is maintained by a friction fit between the main body and the attachment unit.

5. The tape dispenser according to claim 1, wherein the cutting arm is pivotable with respect to the main body and the mandrel axis defines a pivot axis of the cutting arm.

6. The tape dispenser according to claim 1, wherein the cutting arm is pivotable by at least about 90° with respect to the main body.

7. The tape dispenser according to claim 6, wherein the cutting arm is pivotable by at least about 110°.

8. The tape dispenser according to claim 1, comprising a first detent mechanism between the main body and the attachment unit providing a plurality of discrete first detent positions such that a rotational position of the main body with respect to the attachment unit is selectable between the plurality of discrete first detent positions and further comprising:

a second detent mechanism between the main body and the cutting arm providing a plurality of discrete second detent positions such that a rotational position of the cutting arm with respect to the main body is selectable between the plurality of discrete second detent positions.

9. The tape dispenser according to claim 1, wherein the attachment unit comprises a spring biased clamp for clamping the tape dispenser to the furniture.

10. The tape dispenser according to claim 9, wherein the clamp has a receiving opening with a receiving width in the range of 0.5 cm (0.19 inch) to 3.5 cm (1.38 inch).

11. The tape dispenser according to claim 9, wherein the clamp comprises first and second opposingly arranged clamping portions and wherein at least the first or the second clamping portion includes a non-slip material.

12. The tape dispenser according to claim 1, wherein the attachment unit comprises at least one magnet for attaching the tape dispenser to the furniture.

13. The tape dispenser according to claim 1, wherein the attachment unit comprises at least one of a vacuum or suction cup, a clamp, or an adhesive for attaching the tape dispenser to the furniture.

14. The tape dispenser according to claim 1, wherein the cutting arm comprises a first leg extending substantially perpendicular to the mandrel axis from the main body adjacent to the mandrel to support the cutting blade.

15. The tape dispenser according to claim 14, wherein the cutting arm comprises a second leg at an opposite end of the mandrel extending substantially perpendicular to the mandrel axis from the main body adjacent to the mandrel to support the cutting blade.

16. The tape dispenser according to claim 14, wherein a weight of the tape dispenser without the tape roll is less than 150 g (5.3 oz).

17. The tape dispenser according to claim 1, wherein at least the first leg is curved to provide a free space between the cutting arm and a tape portion extending from a tape roll to the blade.

18. The tape dispenser according to claim 1, wherein the cutting arm comprises at least a first recessed side portion forming a free space between the cutting arm and a tape portion extending from a tape roll to the blade.

* * * * *